United States Patent [19]

Jones et al.

[11] 4,149,373

[45] Apr. 17, 1979

[54] COMBUSTION CHAMBER STRESS REDUCING MEANS

[75] Inventors: Dennis C. Jones, Stuart; Paul Matheny, Tequesta, both of Fla.

[73] Assignee: United Technologies Corporation, Hartford, Conn.

[21] Appl. No.: 828,707

[22] Filed: Aug. 29, 1977

[51] Int. Cl.[2] ..... F02C 7/20

[52] U.S. Cl. ..... 60/39.32; 60/39.36

[58] Field of Search ..... 60/39.31, 39.32, 39.36, 60/39.65, 39.69; 285/286; 228/154, 173 F

[56] References Cited

U.S. PATENT DOCUMENTS

| | | | |
|---|---|---|---|
| 1,816,770 | 7/1931 | Gradl | 285/286 |
| 2,858,673 | 11/1958 | Wirt | 60/39.65 |
| 3,468,560 | 9/1969 | Cassel | 285/286 |
| 3,788,065 | 1/1974 | Markowski | 60/39.65 |

*Primary Examiner*—Louis J. Casaregola
*Attorney, Agent, or Firm*—Jack N. McCarthy

[57] ABSTRACT

A gas turbine engine is shown having an annular burner casing with an annular burner therein. A conventional fuel and air supply can be provided. The burner is formed of conventional louver construction at the forward part thereof with the last louver of both the inner and outer burner wall being welded to its upstream louver with a curled forward end being curled to extend away from the upstream louver. This connection is formed on the louvers which restrict the flow through the burner.

4 Claims, 2 Drawing Figures

COMBUSTION CHAMBER STRESS REDUCING MEANS

The invention disclosed herein was made in the performance of or under a contract with the Department of the Air Force.

BACKGROUND OF THE INVENTION

This invention relates to combustion chambers and burners and to the reduction of stresses therein to reduce and eliminate cracking. Where cracks have been discovered in the past, heat shields have been provided, materials have been made thicker and other types of thermal control have been attempted. U.S. Pat. No. 3,286,461 incorporates a tongue-in-groove arrangement between the rear part of the annular combustion liner and the forward edges of the nozzle shrouds.

SUMMARY OF THE INVENTION

An object of this invention is to reduce high stress concentrations between burner louvers where they are connected in areas of high temperature and pressure.

Another object of this invention is to provide a connection where the forward part of a downstream louver is welded to the outer surface of the rearward end of the adjacent upstream louver with the forward part of the downstream louver being curled outwardly with a desired radius of curvature which will provide minimum stress under the limiting thermal and mechanical load condition.

Another object of this invention is to provide an improved louver construction which will permit a welded connection at the forward end of a downstream louver which is flexibly mounted at its rearward end to a turbine which permits a greater growth, said improved construction reduces stress concentration caused by the large moment about the weld as a result of the greater growth.

A further object of this invention is to provide a burner having a side formed of louvers wherein stress levels between louvers where they are connected are controlled by an economical combination of light weight, ease of manufacture, and high effectiveness.

DESCRIPTION OF THE PREFERRED EMBODIMENT

Figure 1:
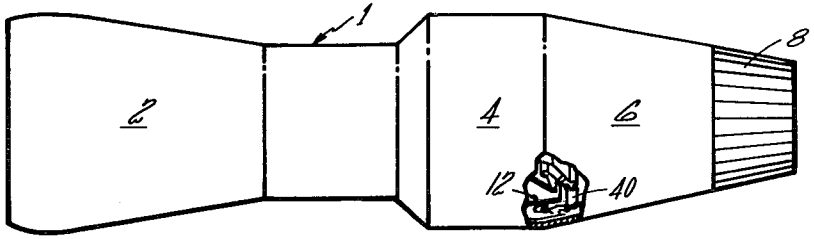
FIG. 1 is a view of a gas turbine engine showing the location of the rear end of the burner.
Figure 2:
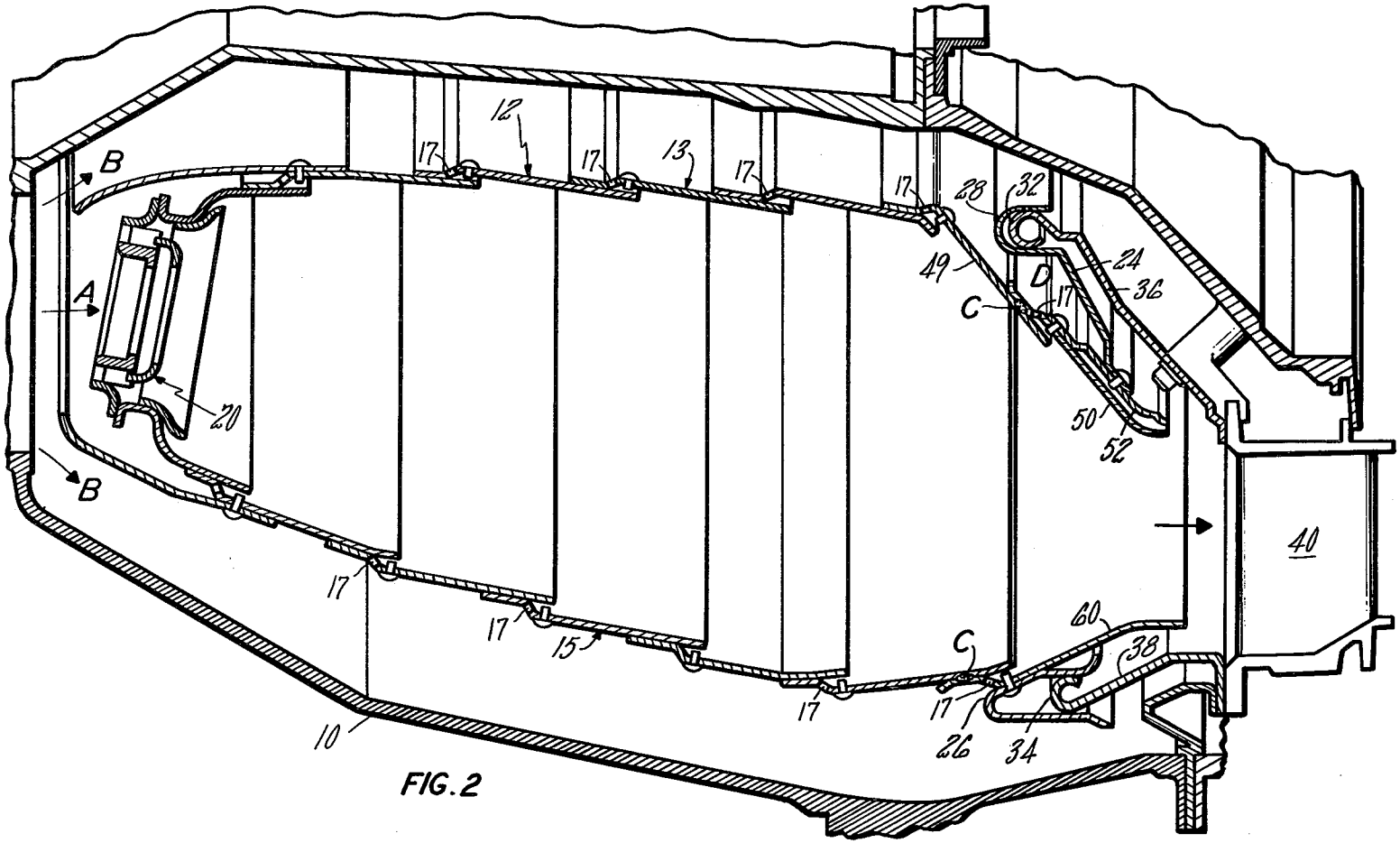
FIG. 2 is an enlarged sectional view of the combustion section showing the casing and burner with its rear louvered construction.

Referring to FIG. 1, a gas turbine power plant is shown generally indicated by 1. The turbine power plant has a compressor 2, a combustion section 4, a turbine section 6 and an exhaust section 8. The combustion section 4 is comprised of an annular burner casing 10 with an annular burner 12 therein. The annular burner 12 comprises an inner annular wall 13 and an outer annular wall 15. A conventional fuel supply and metering control provides the desired fuel flow into the burner. Primary air enters through the forward end of the burner at A while cooling air goes around the annular burner at B. Each annular wall 13 and 15 of the annular burner 12 is formed of conventional louver construction with cooling openings 17 while the last louver 50 of the inner annular wall 13 and the last louver 60 of the outer annular wall 15 has its forward end modified upstream of the weld nugget C. The forward end of each of the louvers 50 and 60 is curled outwardly at a desired radius of curvature. The radius of curvature is made so that the adjacent edge of the forward end of the louver is at least 0.020 inches (0.051 cm) away from the outer surface of the upstream louver. A maximum distance is determined by the interference that the projecting end might have with cooling flow to the cooling opening 17 at the forward end of the louver 50 and 60. It is noted that the nugget size has been shown to be approximately 0.160 inches (0.406 cm).

The last louver 50 of the inner annular wall 13 has an inner liner member 52 fixed at its forward end to the louver 50 with an annular flange 24 extending inwardly from the center thereof. This annular flange 24 has a curved end 28 forming an annular opening which is axially aligned and has a rearward opening. A flange 36 extends forwardly and inwardly from a point adjacent the inner shroud of the turbine blades 40 of the turbine section 6. The end of the flange 36 has an annular bead 32 thereon which is positioned to have axial movement within the portion 28 to provide for thermal changes which will try to move the louver 50 of the wall 13 of the burner 12.

The last louver 60 of the outer annular wall 15 has a member 26 connected thereto forming an annular opening which is axially aligned and has a rearward opening. A flange 38 extends forwardly and outwardly to a point adjacent the cuter shroud of the turbine blades 40 of the turbine section 6. The end of the flange 38 has an annular bead 34 thereon which is positioned to have axial movement within the portion 26 to provide for thermal changes which will try to move the louver 60 of the wall 15 of the burner 12.

In an annular burner constructed, the material used was Haynes 188, while the sheet used had a thickness in the range of 0.034 to 0.043 inches (0.087 to 0.109 cm), the curved end of the forward end of the louver 50 had an inner radius maintained in a range of 0.047 to 0.078 inches (0.119 to 0.198 cm). The end of the curved louver had its inner edge positioned from the adjacent louver somewhere in the range of 0.020 to 0.060 inches (0.050 to 0.152 cm). The nugget size was maintained at approximately 0.160 inches (0.406 cm). Temperatures encountered on the inside of the fifth louver range from 1700° to 1800° F., while the temperature where the sixth louver, louver 50, was fixed to its adjacent upstream louver, was approximately 1200° F. in the space D between the flange 24 and the two louvers, 49 and 50. It can be seen that this is a difference of 500° which is a large temperature differential.

It is further noted that in the construction built, the diameter of the circle formed by the forward curved end of the louver 50 was approximately 17.3 inches (43.9 cm). It can be seen that the diameter of the circle formed of the forward curved end of the louver 60 is greater.

We claim:

1. A combination in the combustion section of a gas turbine engine comprising an annular burner having spaced walls, one of said walls having a louver construction at its downstream end, said spaced walls having limiting thermal and mechanical load conditions, one wall flanging inwardly with relation to the burner adjacent its rear end, a louver fixedly attached thereto for providing the downstream end of the wall, said louver having a forward portion mating with the outer surface of the wall with relation to the burner, said forward portion being welded to the wall, the forward edge of the louver being curled away from the wall forwardly of said weld, said curled away edge of the louver having a radius of curvature, said flanging inwardly inner wall growing outwardly with relation to said louver against said radius of curvature under the limiting thermal and mechanical load conditions without providing high stress concentrations adjacent the weld at the forward edge of the louver.

2. A combination in the combustion section of a gas turbine engine comprising an annular burner having spaced walls, one of said walls having a louver construction at its downstream end, one wall flanging inwardly with relation to the burner adjacent its rear end, a louver fixedly attached thereto for providing the downstream end of the wall, said louver having a forward portion mating with the outer surface of the wall with relation to the burner, said forward portion being welded to the wall, said louver having a second portion rearward of said weld, means mechanically mounting said second portion to said gas turbine engine restricting its radial growth, said mechanical mounting means being mounted in a cooler engine operating area externally of said cooperating louver, the forward edge of the louver being curled away from the wall forwardly of said weld, said curled away edge of the louver having a radius of curvature, said flanging inwardly inner wall growing outwardly with relation to said louver against said radius of curvature during engine operation without providing high stress concentrations adjacent the weld at the forward edge of the louver.

3. A combination as set forth in claim 1 wherein the radius of curvature has a minimum limit of 0.047 inches (0.119 cm).

4. A combination as set forth in claim 1 wherein the end of the curved louver has its inner edge positioned from the adjacent louver at a minimum distance of 0.020 inches (0.050 cm).

* * * * *